US005180247A

United States Patent [19]

Yu

[11] Patent Number: 5,180,247

[45] Date of Patent: Jan. 19, 1993

[54] RING BINDER

[75] Inventor: Cheng H. Yu, Shatin, N.T., Hong Kong

[73] Assignee: World-Wide Stationery Manufacturing Co. Ltd., Hong Kong

[21] Appl. No.: 696,240

[22] Filed: May 6, 1991

[51] Int. Cl.[5] ..... B42F 3/04

[52] U.S. Cl. ..... 402/41; 402/36; 402/38

[58] Field of Search ..... 402/41, 36, 38, 40, 402/39, 37

[56] References Cited

U.S. PATENT DOCUMENTS

| | | | |
|---|---|---|---|
| 3,098,490 | 7/1963 | Wance . | |
| 3,101,719 | 8/1963 | Vernon . | |
| 3,404,685 | 10/1968 | Vernon | 402/41 |
| 3,884,586 | 5/1975 | Michaelis et al. . | |
| 4,522,526 | 6/1985 | Lozfau et al. | 402/41 X |
| 4,813,803 | 3/1989 | Gross | 402/41 X |

FOREIGN PATENT DOCUMENTS 2231536 11/1990 United Kingdom .

*Primary Examiner*—Mark Rosenbaum
*Assistant Examiner*—Willmon Fridie, Jr.
*Attorney, Agent, or Firm*—Wood, Herron & Evans

[57] ABSTRACT

A ring binder includes a base member supporting a plurality of ring members, and an opening mechanism at each end of the base member for opening the plurality of ring members, each opening mechanism including lock means to lock the opening mechanisms in its closed position, the base member comprising a rigid upper structure supporting a pivotable lower structure to which the ring members are mounted, wherein at each end of the binder, the opening mechanism is pivotally supported between the lower structure and the upper structure, externally of the lower structure, and internally of the upper structure.

37 Claims, 6 Drawing Sheets

RING BINDER

This invention relates to a ring binder for loose-leaf binders and the like.

BACKGROUND TO THE INVENTION

There are a variety of known loose-leaf paper ring mechanisms all of which are movable between a closed position and an open position whereby paper or the like can be removed from the rings.

Such ring mechanisms suffer from the problem that the mechanism can be difficult to open, particularly large paper ring mechanisms which have a large closing force to prevent paper falling off the rings. Some known ring mechanisms have attempted to overcome this problem. However, they are complicated in design and have to be manually assembled during manufacture.

It is an object of this invention to overcome one or more of the above problems.

BRIEF SUMMARY OF THE INVENTION

A ring binder, in accordance with the invention, includes a base member supporting a plurality of ring members, and an opening mechanism at each end of the base member for opening the plurality of ring members, each opening mechanism including lock means to lock the opening mechanisms in their closed position, the base member comprising a rigid upper structure supporting a pivotable lower structure to which the ring members are mounted, characterised in that at each end of the binder, the opening mechanism is pivotally supported between the lower structure and the upper structure, externally of the lower structure, and internally of the upper structure.

The advantage of locking the ring members, is that the ring binder is easy to open once unlocked and the sheets of paper in the ring binder will not become detached from the ring members, whilst the advantage of supporting the opening mechanism externally of the lower structure and internally of the upper structure is that the ring binder can be automatically assembled by a machine.

The base of the opening mechanism acts on the underneath of the pivotable lower structure to force this structure to move upwards and pivot, thereby causing the ring members mounted thereto to separate from each other, and open out.

Suitably the lock means comprises a ledge member which cooperates with a corresponding lug member provided on the underneath of the upper structure. In particular, when the opening mechanism is pushed outwardly, the ledge member is disengaged from the lug member.

Alternatively, the lock means comprises a part of the opening mechanism being positioned over centre between the upper and lower structure of the base member.

BRIEF DESCRIPTION OF THE DRAWINGS

The invention will now be described, by way of example, with reference to the accompanying drawings, in which.

DESCRIPTION OF THE PREFERRED EMBODIMENTS

Figure 4:
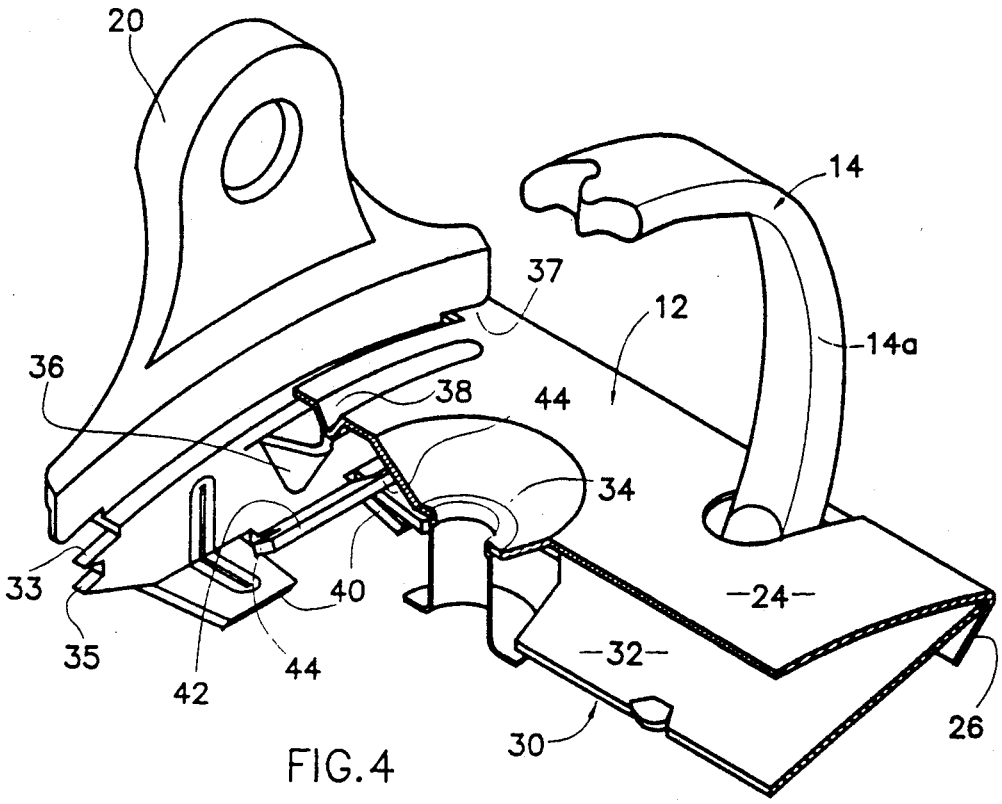
FIG. 4 is a perspective view of the ring binder of FIG. 1 partly in cross-section and in the closed and locked position.
Figure 5:
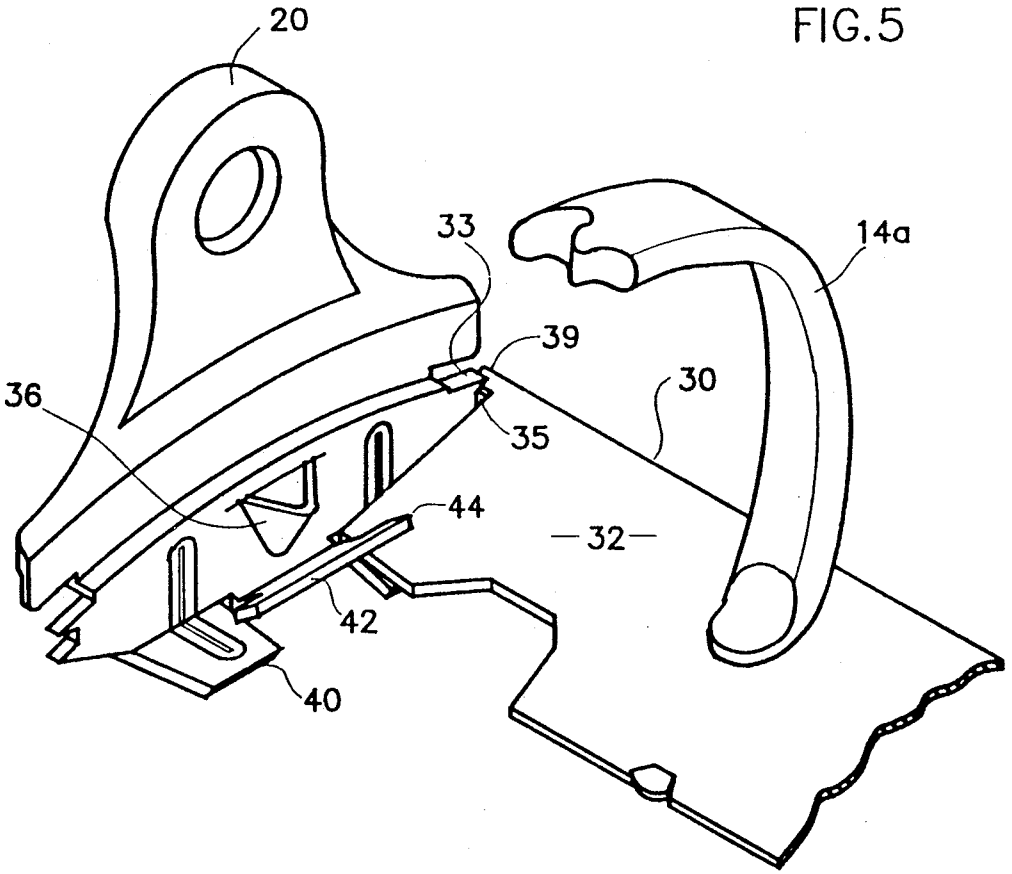
FIG. 5 is a perspective view of the ring binder of FIG. 1 also partly in cross-section and in the closed and locked position.

In FIGS. 1 to 5, a ring binder 10 is shown for a loose-leaf binder comprising a base member 12, three ring members 14 spaced along the base member (one of which is shown in FIGS. 4 & 5), and an opening and locking mechanism 20 at each end of the base member (only one of which is shown).

The base member 12 comprises an upper rigid structure 24 which is curved in cross-section and which supports between its two overlapping sides 26 a pivotable lower structure 30 comprising two carrier rails 32 pivotable to each other along the longitudinal axis of the binder 10.

The ring members 14 are mounted on the pivotable lower structure 30 and in particular, one of the ring components (i.e. component 14*a*) of each ring member is mounted on the carrier rail 32 while the other ring component (not shown) of each ring member is mounted on the other carrier rail ( also not shown).

Fastening means 34, meanwhile, are also provided on the upper structure 24 in order to secure the ring binder 10 to a paper folder or the like.

The two carrier rails 32 are movable (i.e. pivoted) relative to each other between a lower position and an upper position due to the action of the opening and locking mechanism 20 on each end of the carrier rails.

The opening mechanism 20 is pivotably supported on each end of the upper rigid structure 24 and is in engagement with each end of the pivotable lower structure 30 in order to position the opening mechanism 20 between the upper and lower structures. In particular, two projections 33 and 35 one above the other (see FIGS. 4 and 5) on each side of the opening mechanism 20 are provided which are internally enclosed by the crimped end 37 of each side 26 of the upper structure 24, while the projections 33 and 35 are externally placed on top of and below, respectively, the outer side ends 39 of the carrier rails 32 in order to engage and position the lower structure 30 relative the upper structure 24, and to pivotally support the opening mechanism 20 between the lower structure 30 and the upper structure 24. Furthermore, the opening mechanism 20 is supported between the upper and lower structure to allow pivotal movement, but otherwise is fixedly mounted therebetween (i.e. no lateral movement etc).

To provide for easy automated mounting of the opening mechanism 20 between the upper and lower structures 24 and 30, the whole outer ends of the upper structure 24 are substantially unobstructed with downwardly depending flaps and the like. As a result, to assemble the opening mechanism 20 to the ring binder, one only needs to place the opening mechanism 20 directly between the upper and lower structures 24 and 30, and then to crimp (i.e. pinch) together the overlapping end 37 of each side 26 of the upper structure. Since the outer ends of the upper structure 24 are substantially unobstructed with downwardly depending flaps and the like, the additional advantage of saving of material is achieved. In this respect, between 2 and 4% saving of material over known arrangements can be obtained.

Figure 1:
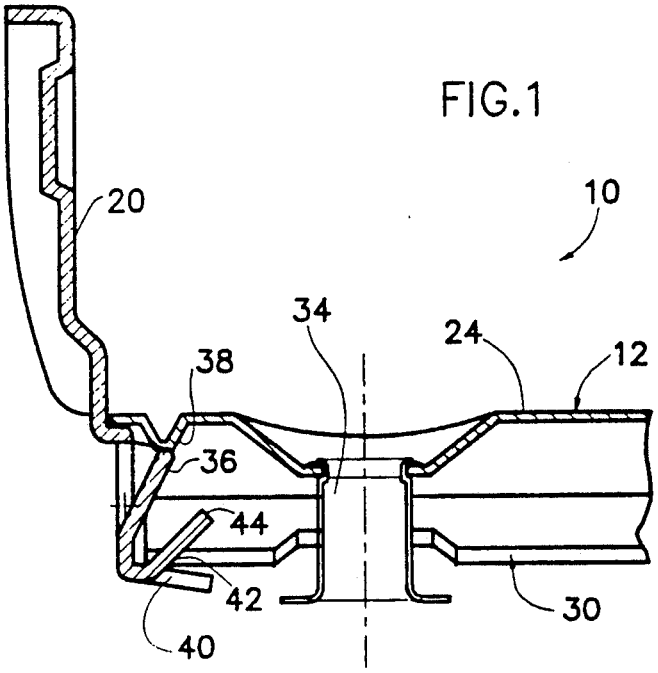
FIG. 1 shows in cross-section the closed and locked position of one end of a first embodiment of the ring binder in accordance with the invention.
Figure 2:
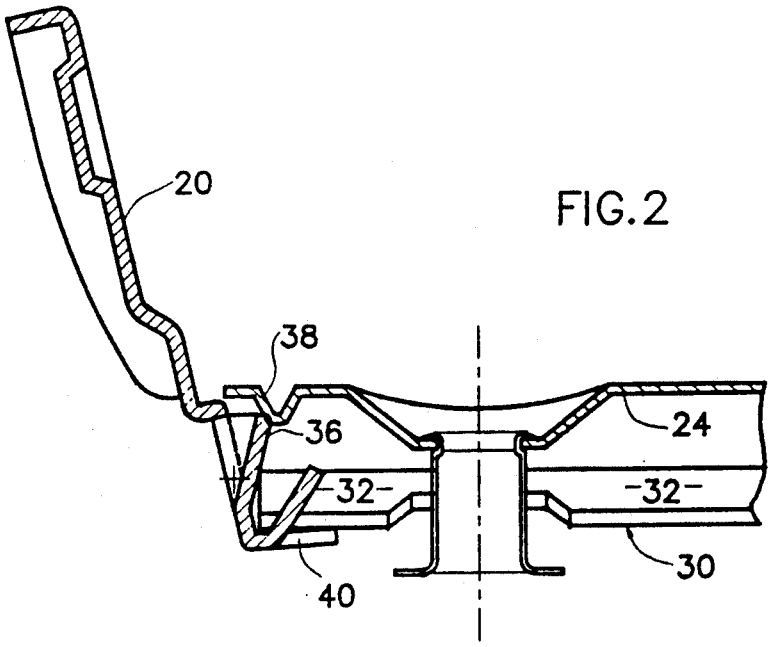
FIG. 2 shows the ring binder of FIG. 1 in the closed and unlocked position.
Figure 3:
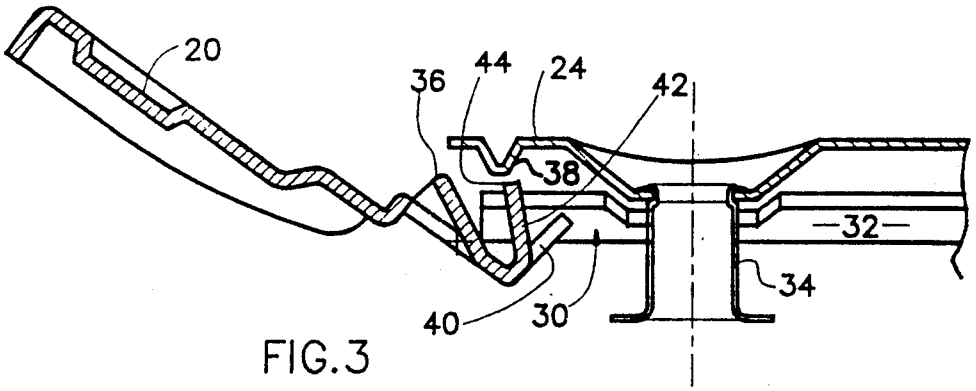
FIG. 3 shows the ring binder of FIG. 1 in the open and unlocked position.

The ring binder has a locked position (see FIG. 1) and two unlocked positions (see FIGS. 2 and 3).

In order to achieve this, the opening mechanism 20 on each end is provided with a first ledge member 36 for cooperating with a lug 38 on the underneath of the upper rigid structure 24 of the base member.

The ring binder has two closed positions (see FIGS. 1 and 2) and an open position (see FIG. 3).

In order to achieve this, the opening mechanism 20 is provided with a second ledge member 40 which is engageable with the underneath of the two pivotable carrier rails 32.

In particular, locking is achieved by the ledge member 36 cooperating with the lug 38 such that in the closed and locked position (see FIG. 1), the ledge member 36 is positioned on one side of the lug 38 whilst in the unlocked position (see FIG. 2), the ledge member 36 is positioned on the other side of the lug 38. In the closed and locked position, the ledge member 40 is not in contact with the underneath of the carrier rails 32 and thus the ring members 14 are in a fully closed position. In the closed and unlocked position, however, the ledge member 40 comes into contact with the underneath of the carrier rails 32 and causes slight upward movement of the carrier rails 32 (but does not cause the carrier rails to pivot upwards).

Opening of the ring members 14, meanwhile is achieved by the opening mechanisms 20 being fully pushed outwards and this causes the ledge member 40 to engage the underneath of the carrier rails 32, whereby these rails flip up (i.e. "snap" pivot) at which point the ring members 14 fully open, and the ring binder 10 is thus then in the open and unlocked position (see FIG. 3).

In addition, the opening/locking mechanism 20 is provided with a third ledge member 42 in order to close the ring members 14 from either the open and unlocked position directly to the closed and locked position, or from the open and unlocked position to the closed and unlocked position. In particular, the third ledge member 42 has outer projections 44 which engage the upper surface of the carrier rails 32 to force the rails to move downwards and pivot downwards.

In FIGS. 6 to 10, a ring binder 50 is shown which is similar in concept to the binder 10 shown in FIGS. 1 to 5. The main difference between the two ring binders is the construction of the opening/locking mechanism 20.

The opening mechanism 20 of the ring binder 50 shown in FIGS. 6 to 10 is pivotally supported on each end of the upper rigid structure 24 and is in engagement with each end of the pivotable lower structure 30 in order to position fixedly the opening mechanism 20 between the upper and lower structures. In particular, a projection 52 (see FIGS. 9 and 10) on each side of the opening mechanism 20 is provided which is internally enclosed by the squashed end 37 (see dotted line in FIG. 9) of each overlapping side 26 of the upper structure 24 while the projections 52 are externally placed at the outer side ends 39 of the carrier rails 32 in order to engage and fixedly position the projection 52 between the lower structure 30 and the upper structure 24. Furthermore, the opening mechanism 20 is supported between the upper and lower structure to allow pivotal movement, but otherwise is fixedly mounted therebetween (i.e. no lateral movement etc).

To provide for easy automated mounting of the opening mechanism 20 between the upper and lower structures 24 and 30, the whole outer ends of the upper structure 24 are substantially unobstructed with downwardly depending flaps and the like. As a result, to assemble the opening mechanism 20 to the ring binder, one only needs to place the opening mechanism 20 directly between the upper and lower structures 24 and 30, and then to crimp (i.e. pinch) together the overlapping end 37 of each side 26 of the upper structure. Since the outer ends of the upper structure 24 are substantially unobstructed with downwardly depending flaps and the like, the additional advantage of saving of material is achieved. In this respect, between 2 and 4% saving of material over known arrangements can be obtained.

The ring binder 50 has two closed positions (see FIGS. 6 and 7) and an open position (see FIG. 8) similar to the ring binder 10 of FIG. 1.

In order to achieve this the opening mechanism 20 on each end is provided with two distinct engagement means, namely first engagement means in the form of a ledge 54 for cooperating with the underneath surface of the pivotable carrier rails 32, and second engagement means also in the form of a ledge member 56 which is engageable with the upper surface of the pivotable carrier rails 32.

Figure 6:
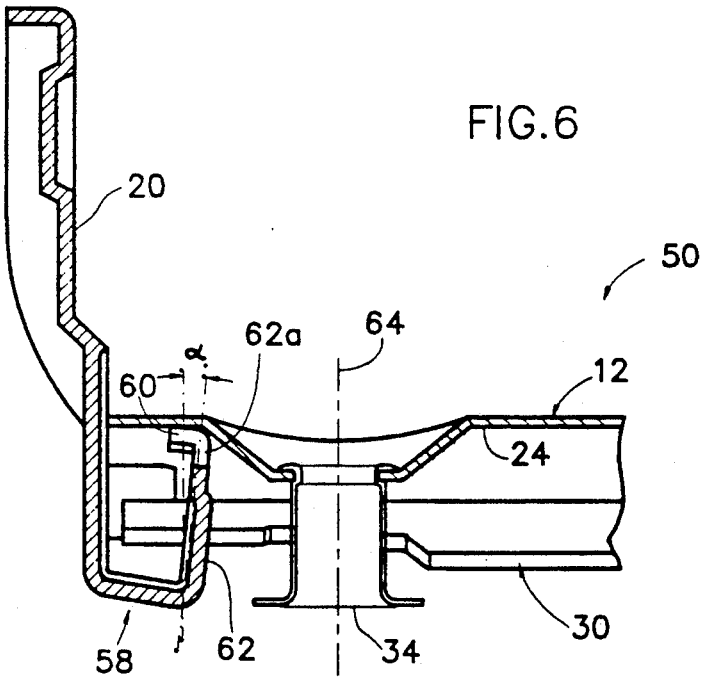
FIG. 6 shows in cross-section the closed and locked position of one end of a second embodiment of the ring binder in accordance with the invention.
Figure 7:
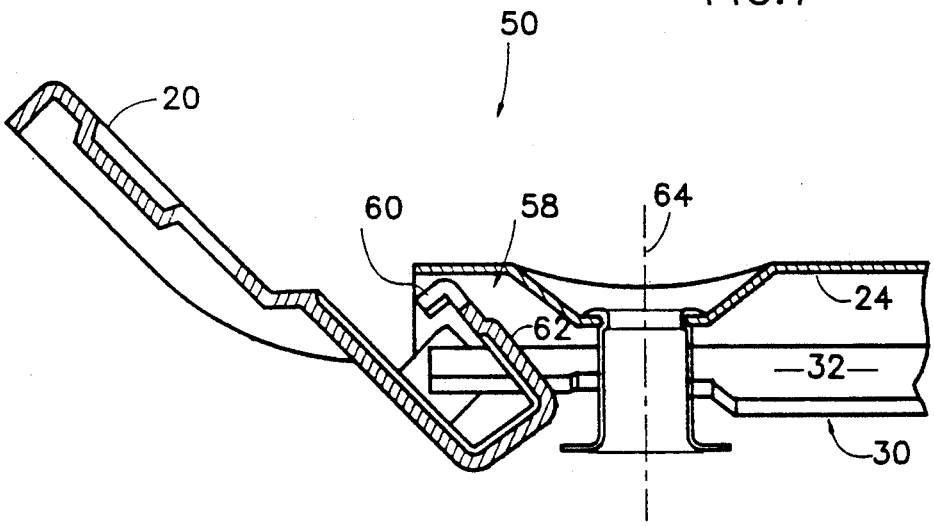
FIG. 7 shows the ring binder of FIG. 6 in the closed and unlocked position.
Figure 8:
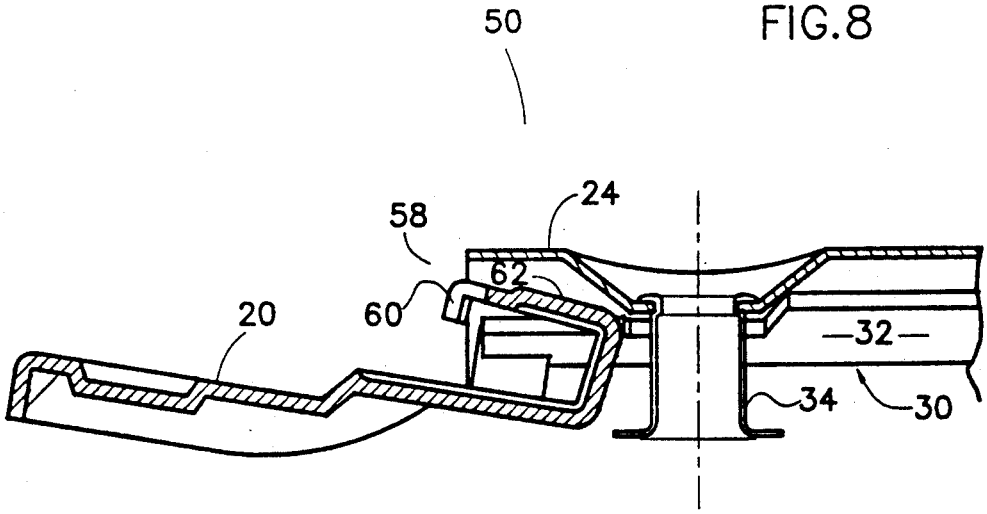
FIG. 8 shows the ring binder of FIG. 6 in the open and unlocked position.
Figure 9:
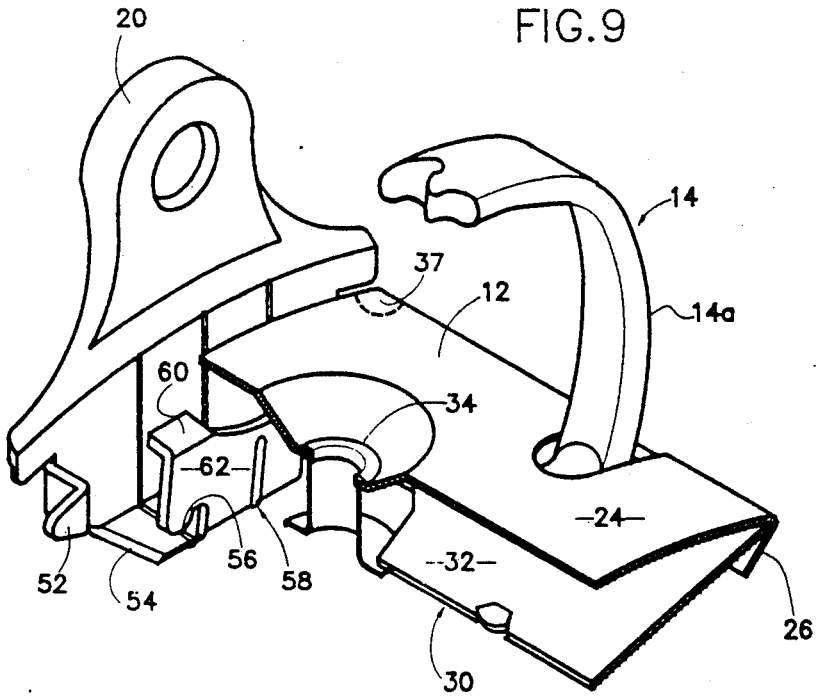
FIG. 9 is a perspective view of the ring binder of FIG. 6 partly in cross-section and in the closed and locked position.
Figure 10:
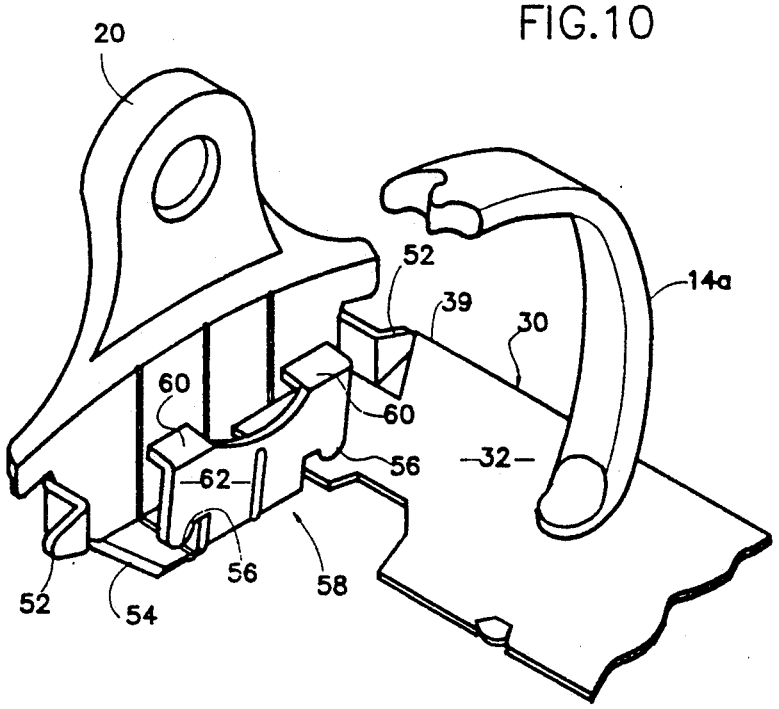
FIG. 10 is a perspective view of the ring binder of FIG. 6 also partly in cross-section and in the closed and locked position.

In particular, the ledge 54 engages the underneath of the carrier rails 32 at the closed position shown in FIG. 7, and further movement of the lever 20 outwardly causes the ledge 54 to push up the underneath of the carrier rails to the open position shown in FIG. 8. Thereafter when the opening mechanism is pulled inwardly to close the rings, the ledge 56 acts on the top of the carrier rails 32 in the open position shown in FIG. 8 to push down the carrier rails 32 to the closed position shown in either FIG. 6 or 7.

The ring binder 50 also has a locked position (see FIG. 6) and two unlocked positions (see FIGS. 7 and 8), similar to the binder 10 shown in FIG. 1. In particular, the locking mechanism 20 is in a basically "b" shaped section where the top of a base portion 58 of the "b" shaped section is provided with a couple of flat surfaces 60 which act against the underneath of the upper structure 24. In the unlocked position of FIG. 7, this top surface 60 is disengaged from the underneath of the upper structure 24; however, once the locking member 20 is moved inwardly, this upper surface 60 comes into contact with the upper structure 24, preferably at the same time as the ledge 56 on the base portion 58 comes into contact with the top of the carrier rails 32.

In particular, it will be seen from FIG. 6 that a front wall 62 of the base portion 58 of the opening mechanism is over centre by an angle $\alpha$, and inwardly directed for instance towards the axis 64 of the fastening means 34 in order to give inherent resistance to unlocking of the opening mechanisms 20. Thus, if the paper held by the rings 14 exerts even large forces tending to open the rings, the mechanism 20 will resist this when in their locked position because such forces will tend to force the front wall 62 to move to the right in the sense viewed in FIGS. 6, so wedging/jamming the front wall 62 of the base portion 58 between the upper structure 24 and the carrier rails 32 and so tending to keep the mechanisms 20 in their locked positions. In particular, the distance along the front wall 62 between the flat surface 60 and the bottom of ledge 56 is slightly greater than the distance between the upper structure 24 and the lower carrier rails 32 when depressed downwards, such that a locking and wedging/jamming effect is achieved.

The upper end 62*a* of the wall 62 is smoothly rounded so that, when the mechanism 20 is moved it does not cut or scar the underside of the base member 12.

The advantage of locking the ring binders 10 and 50 is that the binders are easy to open and the papers within the ring binder will not become dislodged from the ring members, whilst the advantage of supporting the opening mechanism externally of the lower structure and internally of the upper structure is that the ring binder can be assembled by a machine.

A latitude of modification, change and substitution is intended in the foregoing disclosure and in some instances some features of the invention will be employed without a corresponding use of other features. Accordingly it is appropriate that the appended claims be construed broadly and in a manner consistant with the spirit and scope of the invention herein.

I claim:

1. A ring binder including a base member supporting a plurality of ring members, and an opening mechanism at each end of the base member for opening the plurality of ring members, each opening mechanism including lock means to lock the opening mechanisms in their closed position, the base member comprising a rigid upper structure supporting a pivotable lower structure to which the ring members are mounted, wherein at each end of the binder, the opening mechanism is pivotally supported by and between the lower structure and the upper structure, externally of the lower structure, and internally of the upper structure, and wherein a base of the opening mechanism acts on the underneath of the pivotable lower structure to force this lower structure to move upwards and pivot.

2. A ring binder as claimed in claim 1 wherein a base of the opening mechanism acts on the top surface of the pivotable lower structure to force this structure to move downwards and pivot.

3. A ring binder as claimed in claim 1 wherein the lock means comprises a ledge member which cooperates with a corresponding lug member provided on the underneath of the upper structure.

4. A ring binder as claimed in claim 3 wherein the ledge member is positioned relative to the lug member such that when the opening mechanism is pushed outwardly, the ledge member is disengaged from the lug member.

5. A ring binder as claimed in claim 1 wherein the lock means comprises a part of the opening mechanism wedged and positioned at an inwardly directing angle between the upper and lower structure of the base member.

6. A ring binder as claimed in claim 5 wherein the wedged part of the opening mechanism has firstly an upper curved surface portion which is engageable with the correspondingly curved upper structure and secondly an engaging member at the bottom thereof which engages the top surface of the lower structure.

7. A ring binder as claimed in claim 1 wherein the opening mechanism pivots between the upper and lower structures about at least one projection extending from each side of the opening mechanism.

8. A ring binder as claimed in claim 7 wherein each projection is supported adjacent the outer end of the side of the lower structure and by the outer end of the overlapping side of the upper structure, the outer end of the overlapping side of the upper structure being crimped.

9. A ring binder as claimed in claim 1 wherein the whole outer end of the upper structure is substantially unobstructed.

10. A ring binder including a base member supporting a plurality of ring members, and an opening mechanism at each end of the base member for opening the plurality of ring members, each opening mechanism including lock means to lock the opening mechanisms in their closed position, the base member comprising a rigid upper structure supporting a pivotable lower structure to which the ring members are mounted, wherein at each end of the binder, the opening mechanism is pivotally supported by and between the lower structure, and the upper structure, externally of the lower structure, and internally of the upper structure, and wherein a base of the opening mechanism acts on the top surface of the pivotable lower structure to force this lower structure to move downwards and pivot.

11. A ring binder as claimed in claim 10 wherein the lock means comprises a ledge member which cooperates with a corresponding lug member provided on the underneath of the upper structure.

12. A ring binder as claimed in claim 11 wherein the ledge member is positioned relative the lug member such that when the opening mechanism is pushed outwardly, the ledge member is disengaged from the lug member.

13. A ring binder as claimed in claim 10 wherein the lock means comprises a part of the opening mechanism wedged and positioned at an inwardly directing angle between the upper and lower structure of the base member.

14. A ring binder as claimed in claim 13 wherein the wedged part of the opening mechanism has firstly an upper curved surface portion which is engageable with the correspondingly curved upper structure and secondly an engaging member at the bottom thereof which engages the top surface of the lower structure.

15. A ring binder as claimed in claim 10 wherein the opening mechanism pivots between the upper and lower structures about at least one projection extending from each side of the opening mechanism.

16. A ring binder as claimed in claim 15 wherein each projection is supported adjacent the outer end of the side of the lower structure and by the outer end of the overlapping side of the upper structure, the outer end of the overlapping side of the upper structure being crimped.

17. A ring binder as claimed as claim 10 wherein the whole outer end of the upper structure is substantially unobstructed.

18. A ring binder including a base member supporting a plurality of ring members, and an opening mechanism at each end of the base member for opening the plurality or ring members, each opening mechanism including lock means to lock the opening mechanisms in their closed position, the base member comprising a rigid upper structure supporting a pivotable lower structure to which the ring members are mounted, wherein at each end of the binder, the opening mechanism is pivotally supported between the lower structure and the upper structure, externally of the lower structure, and internally of the upper structure, wherein the opening mechanism pivots between the upper and lower structures about at least one projection extending from each side of the opening mechanism, and wherein each projection is supported adjacent the outer end of the side of the lower structure and by the outer end of the overlapping side of the upper structure, the outer end of the overlapping side of the upper structure being crimped.

19. A ring binder as claimed in claim 18 wherein the lock means comprises a ledge member which cooperates with a corresponding lug member provided on the underneath of the upper structure.

20. A ring binder as claimed in claim 19 wherein the ledge member is positioned relative the lug member such that when the opening mechanism is pushed outwardly, the ledge member is disengaged from the lug member.

21. A ring binder as claimed in claim 18 wherein the lock means comprises a part of the opening mechanism wedged and positioned at an inwardly directing angle between the upper and lower structure of the base member.

22. A ring binder as claimed in claim 21 wherein the wedged part of the opening mechanism has firstly an upper curved surface portion which is engageable with the correspondingly curved upper structure and secondly an engaging member at the bottom thereof which engages the top surface of the lower structure.

23. A ring binder as claimed in claim 18 wherein the whole outer end of the upper structure is substantially unobstructed.

24. A ring binder including a base member supporting a plurality of ring members, and an opening mechanism at each end of the base member for opening the plurality of ring members, each opening mechanism including lock means to lock the opening mechanisms in their closed position, the base member comprising a rigid upper structure supporting a pivotable lower structure to which the ring members are mounted, wherein at each end of the binder, the opening mechanism is pivotally supported by and between the lower structure and the upper structure, externally of the lower structure, and internally of the upper structure, wherein a base of the opening mechanism acts on the underneath of the pivotable lower structure to force this lower structure to move upwards and pivot, further wherein the opening mechanism pivots between the upper and lower structures about at least one projection extending from each side of the opening mechanism, each projection being supported adjacent the outer end of the side of the lower structure and by the outer end of the overlapping side of the upper structure, the outer end of the overlapping side of the upper structure being crimped.

25. A ring binder as claimed in claim 24 wherein a base of the opening mechanism acts on the underneath of the pivotable lower structure to force this structure to move upwards and pivot.

26. A ring binder as claimed in claim 24 wherein a base of the opening mechanism acts on the top surface of the pivotable lower structure to force this structure to move downwards and pivot.

27. A ring binder as claimed in claim 24 wherein the lock means comprises a ledge member which cooperates with a corresponding lug member provided on the underneath of the upper structure.

28. A ring binder as claimed in claim 27 wherein the ledge member is positioned relative the lug member such that when the opening mechanism is pushed outwardly, the ledge member is disengaged from the lug member.

29. A ring binder as claimed in claim 24 wherein the lock means comprises a part of the opening mechanism wedged and positioned at an inwardly directing angle between the upper and lower structure of the base member.

30. A ring binder as claimed in claim 29 wherein the wedged part of the opening mechanism has firstly an upper curved surface portion which is engageable with the correspondingly curved upper structure and secondly an engaging member at the bottom thereof which engages the top surface of the lower structure.

31. A ring binder as claimed in claim 24 wherein the whole outer end of the upper structure is substantially unobstructed.

32. A ring binder including a base member supporting a plurality of ring members, and an opening mechanism at each end of the base member for opening the plurality of ring members, each opening mechanism including lock means to lock the opening mechanisms in their closed position, the base member comprising a rigid upper structure supporting a pivotable lower structure to which the ring members are mounted, wherein at each end of the binder, the opening mechanism is pivotally supported by and between the lower structure and the upper structure, externally of the lower structure, and internally of the upper structure, wherein a base of the opening mechanism acts on the top surface of the pivotable lower structure to force this lower structure to move downwards and pivot, further wherein the opening mechanism pivots between the upper and lower structures about at least one projection extending from each side of the opening mechanism, each projection being supported adjacent the outer end of the side of the lower structure and by the outer end of the overlapping side of the upper structure, the outer end of the overlapping side of the upper structure being crimped.

33. A ring binder as claimed in claim 32 wherein the lock means comprises a ledge member which cooperates with a corresponding lug member provided on the underneath of the upper structure.

34. A ring binder as claimed in claim 33 wherein the ledge member is positioned relative the lug member such that when the opening mechanism is pushed outwardly, the ledge member is disengaged from the lug member.

35. A ring binder as claimed in claim 32 wherein the lock means comprises a part of the opening mechanism wedged and positioned at an inwardly directing angle between the upper and lower structure of the base member.

36. A ring binder as claimed in claim 35 wherein the wedged part of the opening mechanism has firstly an upper curved surface portion which is engageable with the correspondingly curved upper structure and secondly an engaging member at the bottom thereof which engages the top surface of the lower structure.

37. A ring binder as claimed in claim 32 wherein the whole outer end of the upper structure is substantially unobstructed.

* * * * *